US005243254A

United States Patent [19]

Kim

[11] Patent Number: 5,243,254

[45] Date of Patent: Sep. 7, 1993

[54] ELECTRON GUN FOR COLOR PICTURE TUBE

[75] Inventor: Won H. Kim, Kyungsangbook, Rep. of Korea

[73] Assignee: Goldstar Co., Ltd., Rep. of Korea

[21] Appl. No.: 769,127

[22] Filed: Sep. 30, 1991

[30] Foreign Application Priority Data

Sep. 29, 1990 [KR] Rep. of Korea ..... 15271

[51] Int. Cl.[5] ..... H01J 29/48

[52] U.S. Cl. ..... 313/414; 315/15; 313/449

[58] Field of Search ..... 313/414, 449; 315/15, 315/382

[56] References Cited

U.S. PATENT DOCUMENTS

| | | | |
|---|---|---|---|
| 4,443,736 | 4/1984 | Chen | 313/414 |
| 4,825,120 | 4/1989 | Takahashi | 315/15 X |
| 4,940,917 | 7/1990 | Stil | 313/414 |
| 5,036,258 | 7/1991 | Chen et al. | 313/414 X |

*Primary Examiner*—Sandra L. O'Shea

*Attorney, Agent, or Firm*—Ostrolenk, Faber, Gerb & Soffen

[57] ABSTRACT

An electron gun for a color picture tube comprising six spaced grid electrodes aligned in the direction that electron beams proceed. The fourth grid electrode comprises a pair of plate-shaped grid electrodes arranged to form a space therebetween and electrically connected with each other. Both plate-shaped grid electrodes are also connected with the second of the grid electrodes so that they receive the same voltage. The space defined between both plate-shaped grid electrodes is variable within the range corresponding to 0.29 to 1.15 times the thickness of each plate-shaped grid electrode. By the construction of the fourth grid electrode, the spaces defined between respective adjacent grid electrodes can be reduced. As a result, the generation of undesirable stray is restricted. Also, the kind of using electrodes can be widely selected, since the space defined between one side fourth grid electrode and the other side fourth grid electrode can be varied.

7 Claims, 2 Drawing Sheets

ELECTRON GUN FOR COLOR PICTURE TUBE

BACKGROUND OF THE INVENTION

The present invention relates to an electron gun for a color picture tube which is capable of freely varying an electron beam emitting angle and a focus voltage ratio with respect to a high-voltage to improve focusing and voltage endurance characteristics.

Referring to FIG. 1, a conventional color picture tube comprises a glass bulb having a panel 2 whose inner surface is covered with fluorescent film 8 to produce a beam spot when an electron beam impacts thereon, and having a funnel 3 around which a deflection yoke 9 is mounted, an electron gun 5 which produces and emits electron beam 6 for R, G and B colors to the panel 2, with sealed in a neck portion 4 of the glass bulb, and a shadow mask 7 which is installed to the inner surface of the panel 2 for the color selection.

To describe the electron gun 5 for the conventional color picture tube in detail, referring to FIG. 2, it comprises three cathodes 10 which emit an electron beam 6 for each of R, G and B colors, being arranged in an in-line manner and first to sixth grid electrodes 11 to 16 which adjust an amount and focusing of the electron beams 6 emitted from the cathodes 10, being supported by bead glass 17 of regular insulator and arranged in the electron beam emitting direction.

The first to the sixth grid electrodes 11 to 16 will be described in detail according to their shapes, applied voltages, and operations.

The first, the second and the fourth grid electrodes 11, 12 and 14 are of the plate shape, while the third, the fifth and the sixth grid electrodes 13, 15 and 16 are of the cap shape.

To the fourth and the sixth grid electrodes 14 and 16 a high voltage Eb is commonly applied so that the electron beams may be accelerated, and to the third and the fifth grid electrodes 13 and 15 a focus voltage Vf, corresponding to 28% or 33% of the high voltage Eb, is applied so that the focusing of the electron beams can be adjusted. And gaps between adjacent grid electrodes of the conventional electron gun are as follows:

| | gap |
|---|---|
| 1st electrode - 2nd electrode | 0.25–0.3 mm |
| 2nd electrode - 3rd electrode | 0.8 mm |
| 3rd electrode - 4th electrode | 1.0 mm |
| 4th electrode - 5th electrode | 1.0 mm |
| 5th electrode - 6th electrode | 1.0 mm |

In a conventional electron gun having such a configuration, the procedure that a picture image is produced from the electron gun will be described.

The electron beams 6 emitted from the cathodes 10 are adjusted in an amount thereof through the first grid electrode 11, and then accelerated in the second grid electrode 12, they enter the third to the sixth grid electrodes 13 to 16 which formulates main and supplementary electrostatic lenses, thereby the focus of the electron beams 6 is adjusted and accelerated so that they impact on the fluorescent film 8 to produce a beam spot.

Such a beam spot passing through the shadow mask 7 which is color selection electrode, its color is selected, and then scanned on the screen by the deflection yoke 9 mounted around the funnel 2 so that the picture can be produced.

In such a conventional electron gun as mentioned above, the high voltage Eb applied to the fourth and the sixth grid electrodes 14 and 16 and the focus voltage Vf applied to the third and the fifth grid electrodes 13 and 15 are limited by the thickness of the fourth grid electrode 14. Furthermore, since, in a currently generally applied electron gun, the focus voltage to high voltage ratio Vf/Eb is 28% or 33%, the thickness of the fourth grid electrode 14 is to be adopted to each case. Thus, the gap between the fourth and the fifth grid electrodes 14 and 15 is also limited.

Accordingly, since the focus voltage of high voltage ratio Vf/Eb is limited in accordance with the thickness of the fourth grid electrode 14, it is limited to reduce the potential difference between the adjacent grid electrodes, the gap between the adjacent grid electrodes is to be 1.0 nm. As a result, when passing through the grid electrodes, the electron beams may be scattered by colliding with an alien substance, lying between the adjacent electrodes, therefore, a picture image is not made on the screen and there happens to be a stray, which is a phenomenon the blue-fluorescence appears between the electron gun 5 and the neck portion 4 of the glass bulb. Due to the stray, flaking of the surface of cathode and short-circuiting of a heater may occur. Furthermore, the higher the high voltage Eb is, the more frequently the stray phenomenon may occur.

SUMMARY OF THE INVENTION

Therefore, it is an object of the present invention to provide an electron gun for color picture tube in which the fourth grid electrode is made of two plate-shaped electrodes to improve the voltage characteristics.

It is another object of the present invention to provide an electron gun for color picture tube in which the voltage characteristics and the focus voltage to high voltage ratio are easily adjusted to apply a relatively low voltage across the adjacent grid electrodes.

Such objects of the present invention can be accomplished by adjusting the high voltage in accordance with the gap between a pair of plate-shaped electrodes of the fourth grid electrode: that is, when applied voltage becomes higher, the gap between the plate-shaped electrodes is made larger, and vice versa. As a result, since making smaller the gap between a pair of plate-shaped electrodes is possible, the applied high voltage may be lowered so that the gaps between adjacent grid electrodes are reduced, thereby possibility of product of scattered electrons can be decreased.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
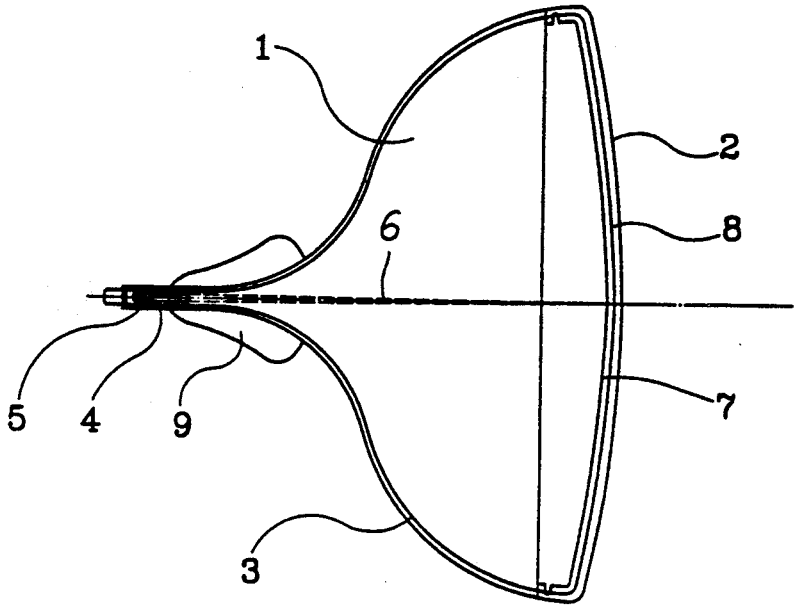
FIG. 1 PRIOR ART
FIG. 1 is a sectional view of the construction of a cathode tube.
Figure 2:
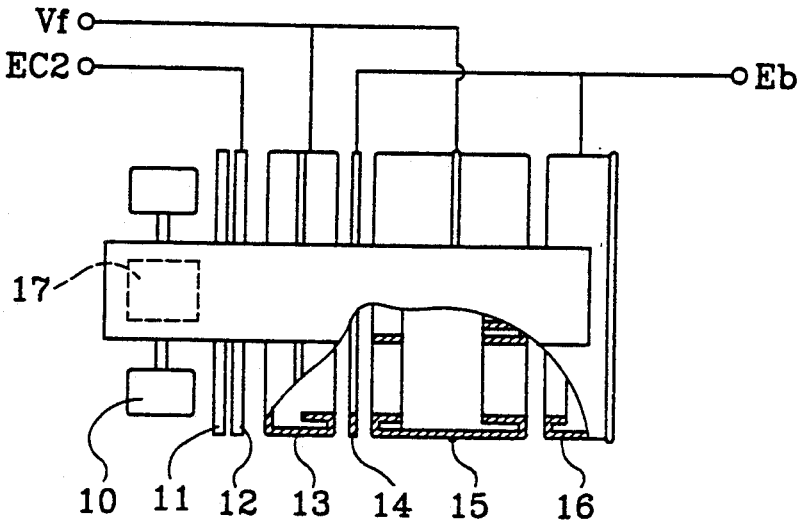
FIG. 2 PRIOR ART
FIG. 2 is a partially broken-away front view of a conventional electron gun.
Figure 3:
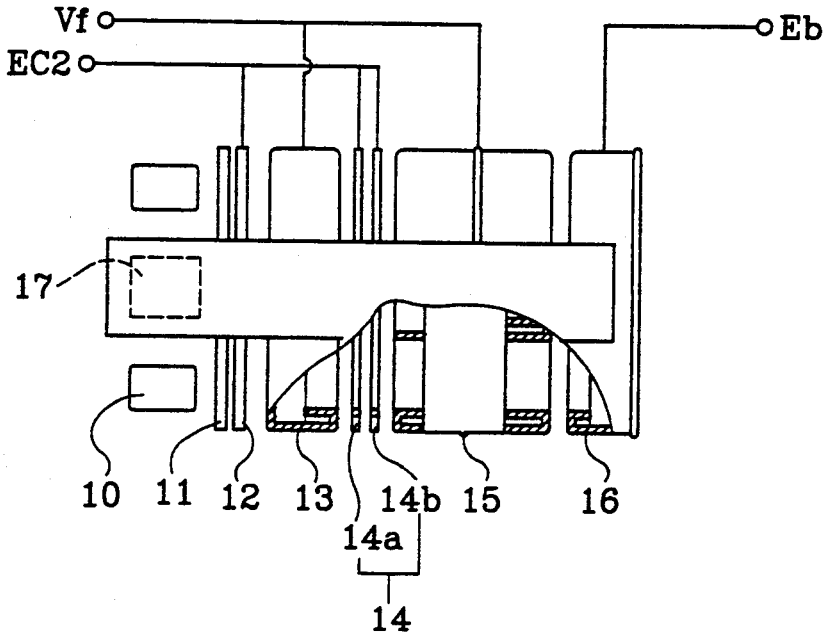
FIG. 3 is a partially broken-away front view of an electron gun in accordance with the present invention.

Referring to FIG. 3, the present invention will be described in detail.

And electron gun for a color picture tube according to the present invention comprises a first to a sixth grid electrodes arranged in a line. The fourth grid electrode 14 comprises a pair of plate-shaped grid electrodes 14*a* and 14*b* of the same shape which are spaced in a certain distance from each other and to which a equivoltage of low voltage $EC_2$ is applied together with the second grid electrode 12. And a high voltage Eb is applied to the sixth grid electrode 16 only.

The one side and other side grid electrodes 14*a* and 14*b* of the fourth grid electrode 14 are formulated 0.7 mm in their thickness, and the gap therebetween is as 0.29 to 1.15 times as their thickness so that the focus voltage Vf applied to the third and the fifth grid electrodes 13 and 15 which are adjacent to one side and the other side grid electrodes 14*a* and 14*b* of the fourth grid electrode 14, respectively.

An embodiment of arranging the gride electrodes according to the present invention will be illustrated below.

The gap defined between the first and the second grid electrodes 11 and 12 is 0.25 mm, the gap defined between the second and the third grid electrodes 12 and 13 is 0.6 mm, and the gap defined between the third grid electrode 13 and the one side grid electrode 14*a* of the fourth grid electrode 14 is 0.6 mm, which is identical to the gap defined between the one side and the other side grid electrodes 14*a* and 14*b* of the fourth grid electrode 14, and to the space defined between the other side grid electrode 14*b* of the fourth grid electrode 14 and the fifth grid electrode 15. Also, the space defined between the fifth and the sixth grid electrode 15 and 16 is 1.0 mm.

To the one side grid electrode 14*a*, to the other side grid electrode 14*b* and to the second grid electrode 12, the same voltage, particularly a voltage of 200V to 600V, is applied, as a result, the potential difference between the third grid electrode 13 and the one side grid electrode 14*a* and the potential difference between the other side grid electrode 14*b* and the fifth grid electrode 15 are made lower to 37% to 38% of the potential difference occurred high in the prior art which uses a fourth grid electrode of a single electrode.

A focus voltage Vf can be varied within the range of 28% to 33% of the focus of high voltage ratio by variability of the gap between both side grid electrodes 14*a* and 14*b* of the fourth grid electrode 14 adjacent respectively to the third and the fifth grid electrodes 13 and 15.

As described above, since the potential difference between the adjacent grid electrodes can be lowered, the gaps between the adjacent grid electrodes can also be reduced as illustrated below.

| | gap |
|---|---|
| 1st electrode - 2nd electrode | 0.25 mm |
| 2nd electrode - 3rd electrode | 0.6 mm |
| 3rd electrode - one side 4th electrode | 0.6 mm |
| one side 4th electrode - other side 4th electrode | 0.6 mm |
| other side 4th electrode - 5th electrode | 0.6 mm |
| 5th electrode - 6th electrode | 1.0 mm |

As apparent from the above description, the present invention providing an electron gun in which the fourth grid electron consist of a pair of plate-shaped grid electrodes so that the spaces between the adjacent grid electrodes can be reduced, the applied voltages can be lowered, thereby the electron beams are prevented from being scattered and leaked between respective adjacent grid electrodes when passing through the grid electrodes and a stray phenomenon is avoided.

Furthermore, the focus voltage to high voltage ratio Vf/Eb is easily adjusted since the gap defined between one side grid electrode and the other side grid electrode of the fourth grid electrode can be varied, accordingly the voltage characteristics of applicable electrodes can be widely selected.

What is claimed is:

1. An electron gun for use in a color cathode ray tube comprising:

a plurality of cathodes each for generating an electron beam;

a first grid electrode;

a second grid electrode for accelerating said electron beam from said cathodes by receiving a low-voltage;

a third grid electrode for receiving a focus voltage;

a fourth grid electrode having two plate-shape electrodes with an electrical potential commensurate with said second grid electrode, the gap between said plate-shape electrodes being variable in response to a voltage applied thereto, and means for applying the same voltage to said plate-shape electrodes;

a fifth grid electrode for controlling the focusing of said electron beam, said fifth grid electrode having an electrical potential commensurate with said third grid electrode; and a sixth grid electrode for accelerating said electron beam from said cathodes by receiving a high-voltage.

2. The electron gun as claimed in claim 1, wherein the thickness of each of said plate-shape electrodes is about 0.7 mm.

3. The electron gun as claimed in claim 1, wherein the gap between said plate-shape electrode is about 0.29 to 1.15 times as the thickness of each of the plate-shape electrodes.

4. The electron gun as claimed in claim 1, wherein the gaps defined between respective adjacent ones of the first to the sixth grid electrodes are each about 0.25 mm, 0.6 mm, 0.6 mm, 0.6 mm, 0.6 mm and 1.0 mm, in order of their alignment.

5. An electron gun for use in a color cathode ray tube comprising:

a plurality of cathodes each for generating an electron beam;

a first grid electrode;

a second grid electrode for accelerating said electron beam from said cathodes by receiving a low-voltage;

a third grid electrode for receiving a focus voltage;

a fourth grid electrode having two plate-shape electrodes with an electrical potential commensurate with said second grid electrode, the gap between said plate-shape electrodes being variable in response to a voltage applied thereto;

a fifth grid electrode for controlling the focusing of said electron beam, said fifth grid electrode having an electrical potential commensurate with said third grid electrode; and a sixth grid electrode for accelerating said electron beam from said cathodes by receiving a high-voltage;

wherein the thickness of each of said plate-shape electrodes is about 0.7 mm.

6. An electron gun for use in a color cathode ray tube comprising:

a plurality of cathodes each for generating an electron beam;

a first grid electrode;

a second grid electrode for accelerating said electron beam from said cathodes by receiving a low-voltage;

a third grid electrode for receiving a focus voltage;

a fourth grid electrode having two plate-shape electrodes with an electrical potential commensurate with said second grid electrode, the gap between said plate-shape electrodes being variable in response to a voltage applied thereto;

a fifth grid electrode for controlling the focusing of said electron beam, said fifth grid electrode having an electrical potential commensurate with said third grid electrode; and a sixth grid electrode for accelerating said electron beam from said cathodes by receiving a high-voltage;

wherein the gap between said plate-shape electrodes is about 0.29 to 1.15 times as the thickness of each of the plate-shape electrodes.

7. An electron gun for use in a color cathode ray tube comprising:

a plurality of cathodes each for generating an electron beam;

a first grid electrode;

a second grid electrode for accelerating said electron beam from said cathodes by receiving a low-voltage;

a third grid electrode for receiving a focus voltage;

a fourth grid electrode having two plate-shape electrodes with an electrical potential commensurate with said second grid electrode, the gap between said plate-shape electrodes being variable in response to a voltage applied thereto;

a fifth grid electrode for controlling the focusing of said electron beam, said fifth grid electrode having an electrical potential commensurate with said third grid electrode; and a sixth grid electrode for accelerating said electron beam from said cathodes by receiving a high-voltage;

wherein the gaps defined between respective adjacent ones of the first to the sixth grid electrodes are each about 0.25 mm, 0.6 mm, 0.6 mm, 0.6 mm and 0.1 mm, in order of their alignment.

* * * * *